US011000726B2

(12) United States Patent
Gonzalez

(10) Patent No.: US 11,000,726 B2
(45) Date of Patent: May 11, 2021

(54) PORTABLE HAND CYCLE

(71) Applicant: Heriberto Gonzalez, Brooksville, FL (US)

(72) Inventor: Heriberto Gonzalez, Brooksville, FL (US)

( * ) Notice: Subject to any disclaimer, the term of this patent is extended or adjusted under 35 U.S.C. 154(b) by 0 days.

(21) Appl. No.: 16/535,657

(22) Filed: Aug. 8, 2019

(65) Prior Publication Data

US 2020/0171345 A1 Jun. 4, 2020

Related U.S. Application Data

(60) Provisional application No. 62/773,218, filed on Nov. 30, 2018.

(51) Int. Cl.

*A63B 22/00* (2006.01)
*A63B 22/06* (2006.01)
*A63B 21/00* (2006.01)

(52) U.S. Cl.

CPC ..... *A63B 22/0005* (2015.10); *A63B 21/4034* (2015.10); *A63B 21/4035* (2015.10);

(Continued)

(58) Field of Classification Search

CPC ..... A47C 9/002; A63B 21/00058; A63B 21/00069; A63B 21/00076; A63B 21/00192; A63B 21/005; A63B 21/0051; A63B 21/0052; A63B 21/0056; A63B 21/0057; A63B 21/008; A63B 21/0084; A63B 21/00845; A63B 21/0085; A63B 21/0088; A63B 21/012; A63B 21/0125; A63B 21/018; A63B 21/22; A63B 21/225; A63B 21/4027; A63B 21/4033; A63B 21/4035; A63B 21/4049; A63B 22/0002; A63B 22/0005; A63B 22/0046; A63B 22/0048; A63B 22/06; A63B 22/0605; A63B 22/0694; A63B 2022/0611; A63B 2022/0635; A63B 23/12; A63B 23/1209; A63B 23/1245; A63B 71/0009; A63B 71/023; A63B 2071/0018;

(Continued)

(56) References Cited

U.S. PATENT DOCUMENTS 1,820,372 A * 8/1931 Blomquist ..... A63B 22/0005 482/62
4,881,732 A * 11/1989 Kepiro ..... A63B 22/001 482/62

(Continued)

*Primary Examiner* — Gary D Urbiel Goldner
(74) *Attorney, Agent, or Firm* — Larson & Larson, P.A.; Justin P. Miller; Frank Liebenow

(57) ABSTRACT

The portable hand cycle is a user-stabilized device for upper body exercise. The portable hand cycle is held in place using the weight of a user, holding a platform against the seat of a chair, couch, or other surface. In a sitting position, a riser connected to the seat extends up and away from the user. The riser is optionally of an adjustable length in order to fit users of different sizes. The riser ends with a sleeve that encloses an axle, the center of which is placed at chest-level with respect to the user. The crank is connected to a pair of crank-arms that in turn terminate with grips. To operate, the user extends her arms and holds the grips in her hands. Her rotation of her hands moves the grips, which in turn rotates the crank-arms, finally rotating the axle.

5 Claims, 9 Drawing Sheets

(52) U.S. Cl.
CPC ..... *A63B 22/0012* (2013.01); *A63B 22/0605* (2013.01); *A63B 22/0694* (2013.01); *A63B 2208/0233* (2013.01)

(58) Field of Classification Search
CPC ..... A63B 2071/026; A63B 2071/027; A63B 2208/0228; A63B 2208/0233; A63B 2208/0238; A63B 2210/00; A63B 2210/02; A63B 2210/50; A63B 2225/09; A63B 2225/093
See application file for complete search history.

(56) References Cited

U.S. PATENT DOCUMENTS 5,108,092 A * 4/1992 Hurst ..... A63B 22/0005 482/60
5,490,824 A * 2/1996 Wang ..... A63B 22/0007 482/119
5,647,822 A * 7/1997 Avganim ..... A63B 22/0007 482/57
D482,416 S * 11/2003 Yang ..... A63B 22/001 D21/663
7,695,410 B2 * 4/2010 Kim ..... A63B 21/1609 482/57
9,566,469 B1 * 2/2017 Rector ..... A63B 23/0476
2006/0085903 A1 * 4/2006 Renna ..... A63B 22/0605 4/546
2011/0281693 A1 * 11/2011 Arstein ..... A63B 21/00192 482/57
2012/0202655 A1 * 8/2012 Gomez ..... A63B 21/072 482/105
2014/0113776 A1 * 4/2014 Jaguan ..... A63B 21/015 482/57
2014/0342845 A1 * 11/2014 Dingman ..... A63B 60/14 473/297
2018/0228682 A1 * 8/2018 Bayerlein ..... A61H 1/0274

* cited by examiner

PORTABLE HAND CYCLE

CROSS-REFERENCE TO RELATED APPLICATION

This application is a continuation-in-part of U.S. Pat. App. Ser. No. 62/773,218, filed Nov. 30, 2018, titled Portable Hand Cycle.

FIELD

This invention relates to the field of exercise equipment and more particularly to a hand cycle that can be operated anywhere in a sitting position.

BACKGROUND

Studies consistently show that everyone can benefit from increased physical activity. A primary hurdle to the incorporation of additional activity into daily lives is that it comes at the expense of other tasks and activities that an individual may prefer. For example, watching the news, supervising children, or waiting for food to cook.

While these activities do not intrinsically prevent an individual from exercising, incorporating exercise is made difficult by the required cost of exercise equipment and the associated space requirements.

The difficulty of incorporating additional physical activity is further increased for those with limited leg mobility due to a handicap, age, or health condition.

What is needed is a device that allows one to easily incorporate exercise into existing activities without being a financial burden or requiring significant space.

SUMMARY

The portable hand cycle is a user-stabilized device for upper body exercise. The portable hand cycle is held in place using the weight of a user, holding a platform against the seat of a chair, couch, or other surface.

In a sitting position, a riser connected to the seat extends up and away from the user. The riser is optionally of an adjustable length in order to fit users of different sizes.

The riser ends with a sleeve that encloses an axle, the center of which is placed at chest-level with respect to the user.

The crank is connected to a pair of crank-arms that in turn terminate with grips. To operate, the user extends her arms and holds the grips in her hands. Her rotation of her hands moves the grips, which in turn rotates the crank-arms, finally rotating the axle.

The rotational resistance of the axle is adjustable by the user, thereby adjusting the difficulty of operation. A resistance mechanism interfaces with the axle. By adjusting the amount of force used to compress a brake pad against axle, the user may adjust the difficulty of axle rotation.

Alternatively, the crank may interface with a resistance-creating device, such as a fan, flywheel, flywheel with brake, air paddle, paddles submerged in a water tank, or other such resistance-creating mechanism.

The grips, or handles, are preferably ovoid, or egg-shaped. This shape is comfortable for users to grip despite the different hand sizes of different users.

Alternative handle shapes include spherical, rod-shaped, paddle-shaped, joystick-style grip—any of which optionally include a strap that surrounds the back of a user's hand.

Connecting each grip to its crank-arm is a stem that connects to either the right or left crank arm at a joint.

The joint is preferably a ball joint, with the ball half located at the termination of the stem, and the socket placed within the crank arm.

This joint is preferred because it allows rotation of the stem along its axis, with respect to the crank arm, as well as rotation front-to-back and up-and-down. The result is that a user may maintain a neutral wrist position throughout the path of rotation.

As an alternative to the stabilizing structure of a seat described above, the portable hand cycle is stabilized using leg rests.

In this alternative embodiment, the riser splits as it moves away from the crank, resulting in a pair of angled risers, each of which terminates in a cuff. Each cuff rests atop a user's leg, providing stabilization. Optionally included is a band that wraps under each user's leg, thus permitting a user to tighten each cuff against her legs.

As an alternative to the stabilizing structures described above, the portable hand cycle is stabilized using a rear foot, further supported by a front foot connect to the riser by a support leg.

In this alternative embodiment, the base of the riser includes one or more feet that support the hand cycle with respect to a surface, such as the floor.

An arm, angled away from the riser, connects to a second foot to provide further stability.

This alternative embodiment also includes the option of a foot pedal mechanism to allow the user to move both his hands and feet simultaneously.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
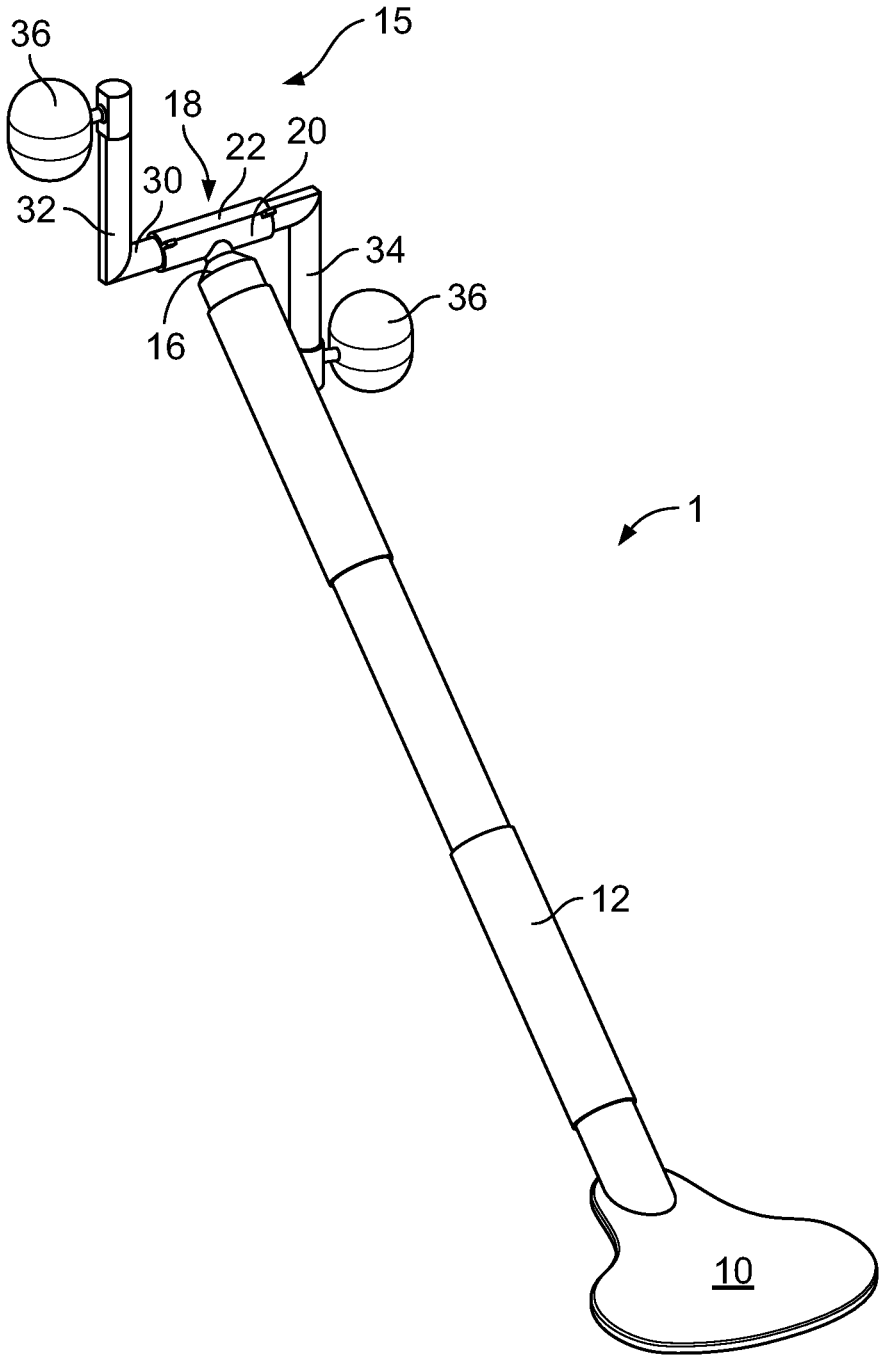
FIG. 1 illustrates a first isometric view of the portable hand cycle.

Reference will now be made in detail to the presently preferred embodiments of the invention, examples of which are illustrated in the accompanying drawings. Throughout the following detailed description, the same reference numerals refer to the same elements in all figures.

Figure 2:
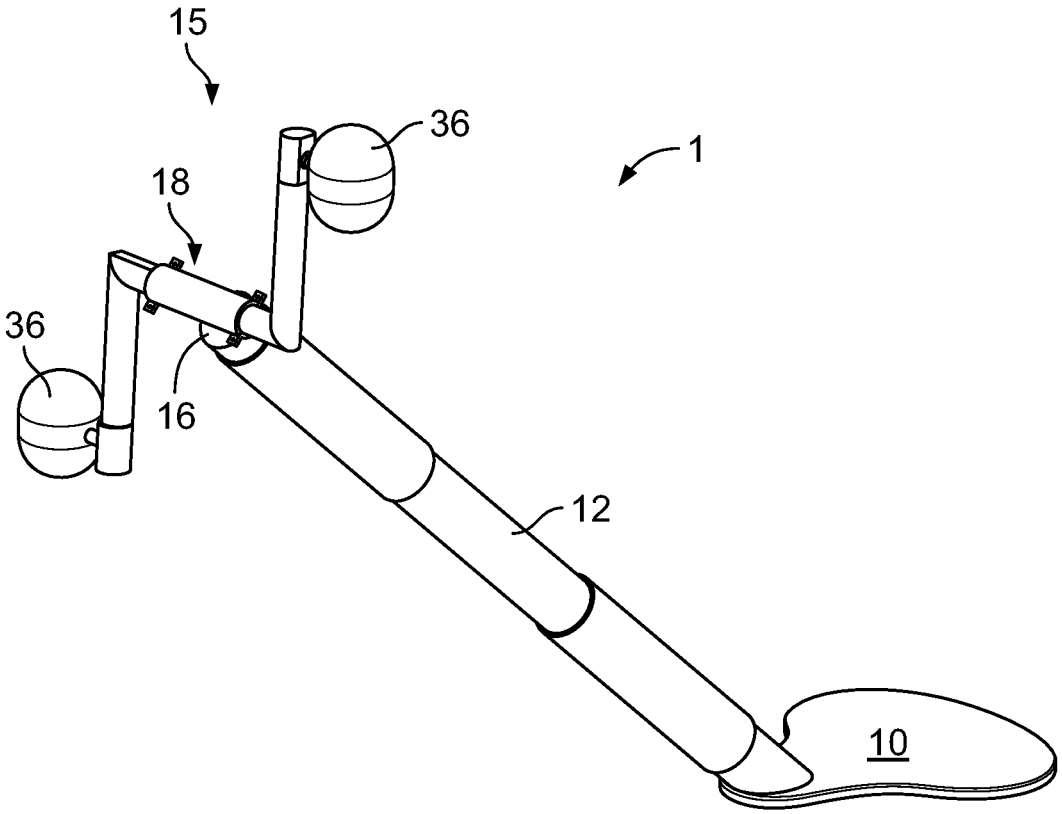
FIG. 2 illustrates a second isometric view of the portable hand cycle.

Referring to FIGS. 1 and 2, isometric views of the portable hand cycle are shown.

Starting from the bottom, the portable hand cycle 1 includes a seat 10 connected to a riser 12. Junction 16 connects to the hand cycle mechanism 15. The hand cycle mechanism 15 includes a sleeve 18, formed from lower half 20 and upper half 22. Rotating within the sleeve 18 is axle 30, which in turn connects to left crank-arm 32 and right crank-arm 34. Each crank-arm 32/34 ends in a grip 36.

Figure 3:
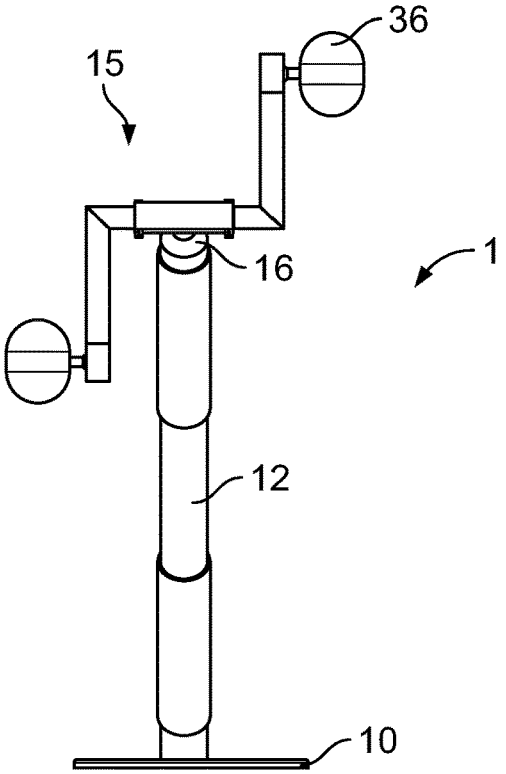
FIG. 3 illustrates a front view of the portable hand cycle.
Figure 4:
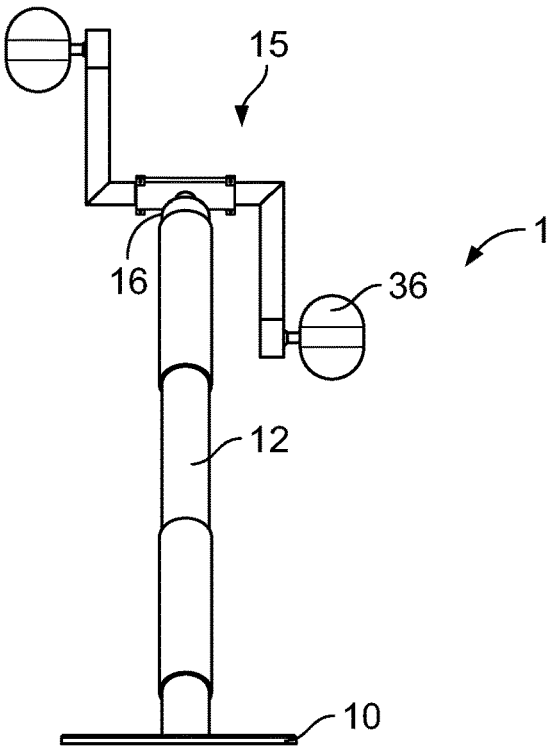
FIG. 4 illustrates a back view of the portable hand cycle.
Figure 5:
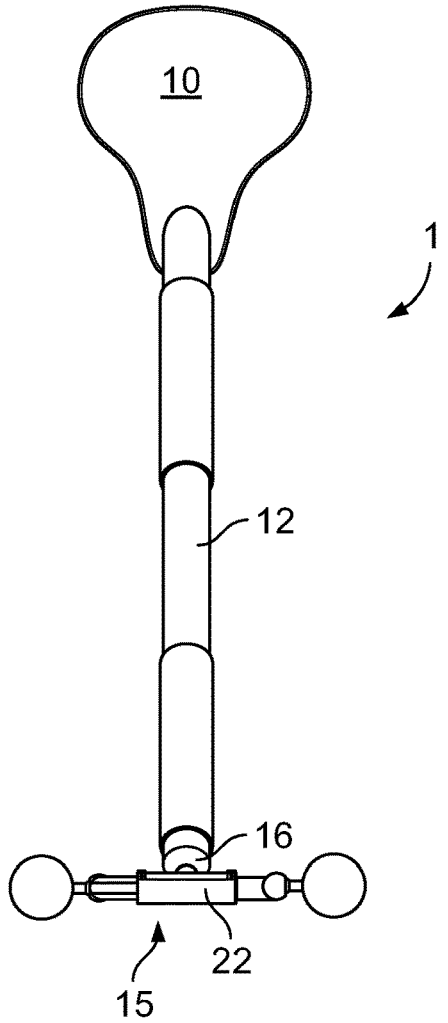
FIG. 5 illustrates a top view of the portable hand cycle.

Referring to FIGS. 3, 4, and 5, a front view, back view, and top view of the portable hand cycle are shown.

The portable hand cycle 1 is again shown with primary components seat 10, riser 12, junction 16, hand cycle mechanism 15, and grips 36.

Figure 6:
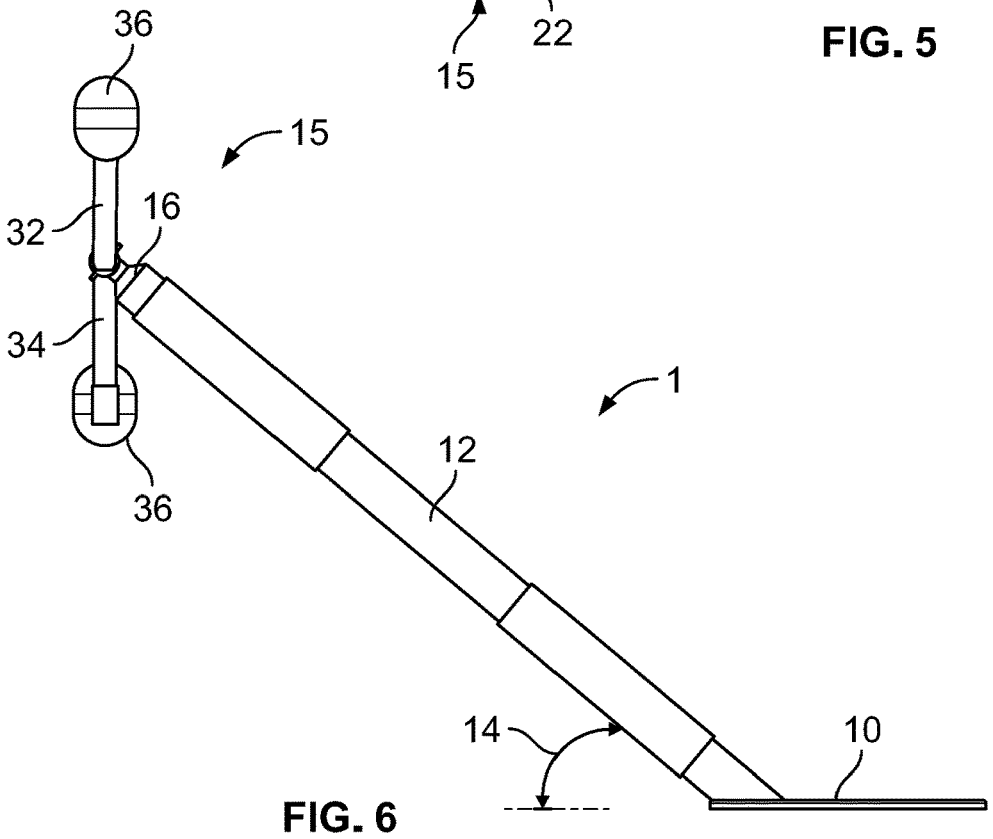
FIG. 6 illustrates a side view of the portable hand cycle.

Referring to FIG. 6, a side view of the portable hand cycle is shown.

The riser 12 of the portable hand cycle 1 is set at a riser angle 14 with respect to horizontal, or the plane of the seat 10. The preferred riser angle 14 is 30 degrees, but the riser angle 14 may be altered depending on the intended user for the portable hand cycle 1.

Figure 7:
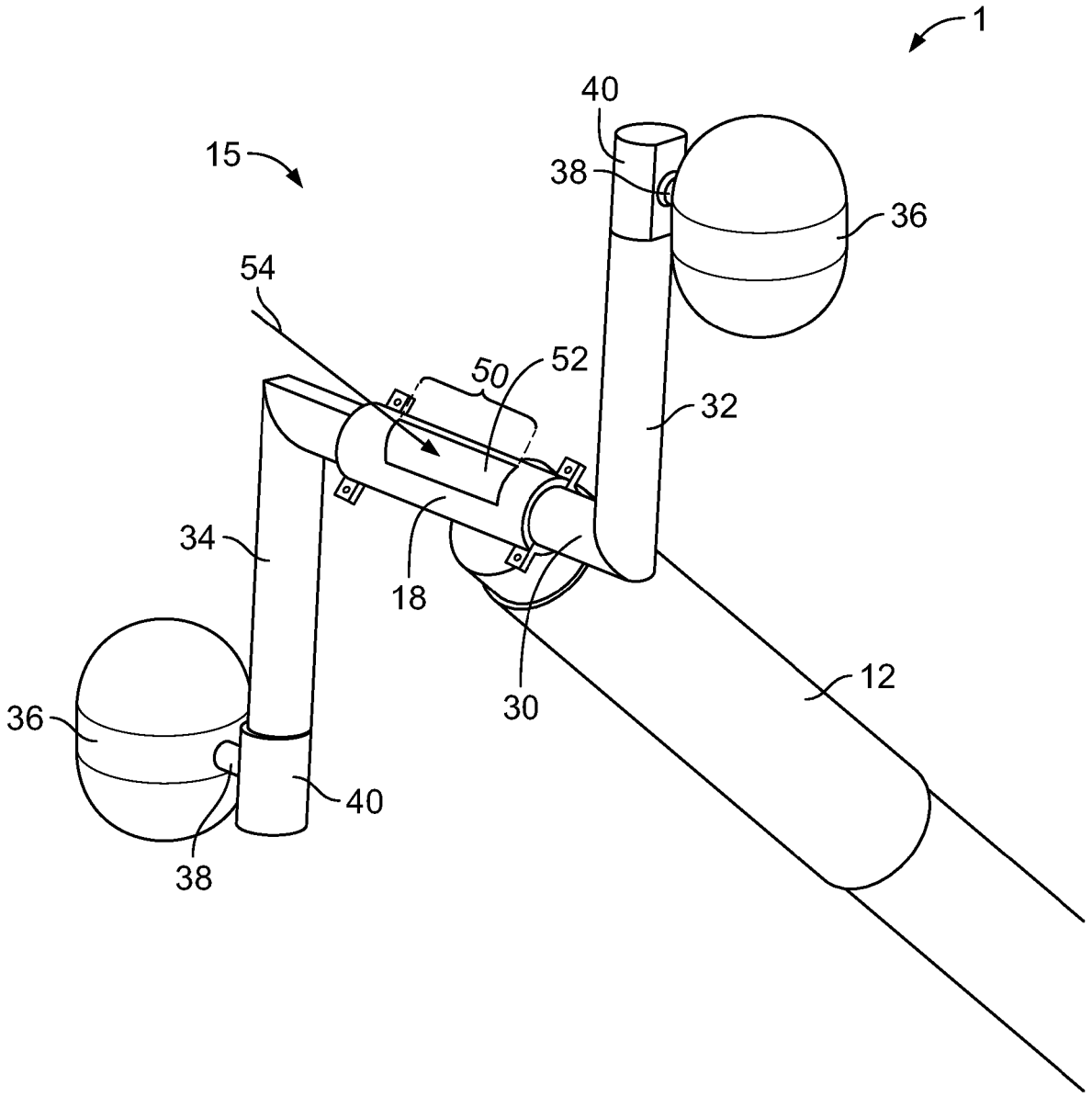
FIG. 7 illustrates a detail view of the rotating portion of the portable hand cycle.

Referring to FIG. 7, a detail view of the hand cycle mechanism of the portable hand cycle is shown.

The hand cycle mechanism 15 includes an axle 30 that rotates within sleeve 18. Connected to axle 30 are the left crank-arm 32 and right crank-arm 34, each of which ends in a joint 40 that includes a stem 38, each stem 38 terminating in a grip 36.

The optional resistance mechanism 50 includes a brake pad 52 and brake compression adjuster 54.

Figure 8:
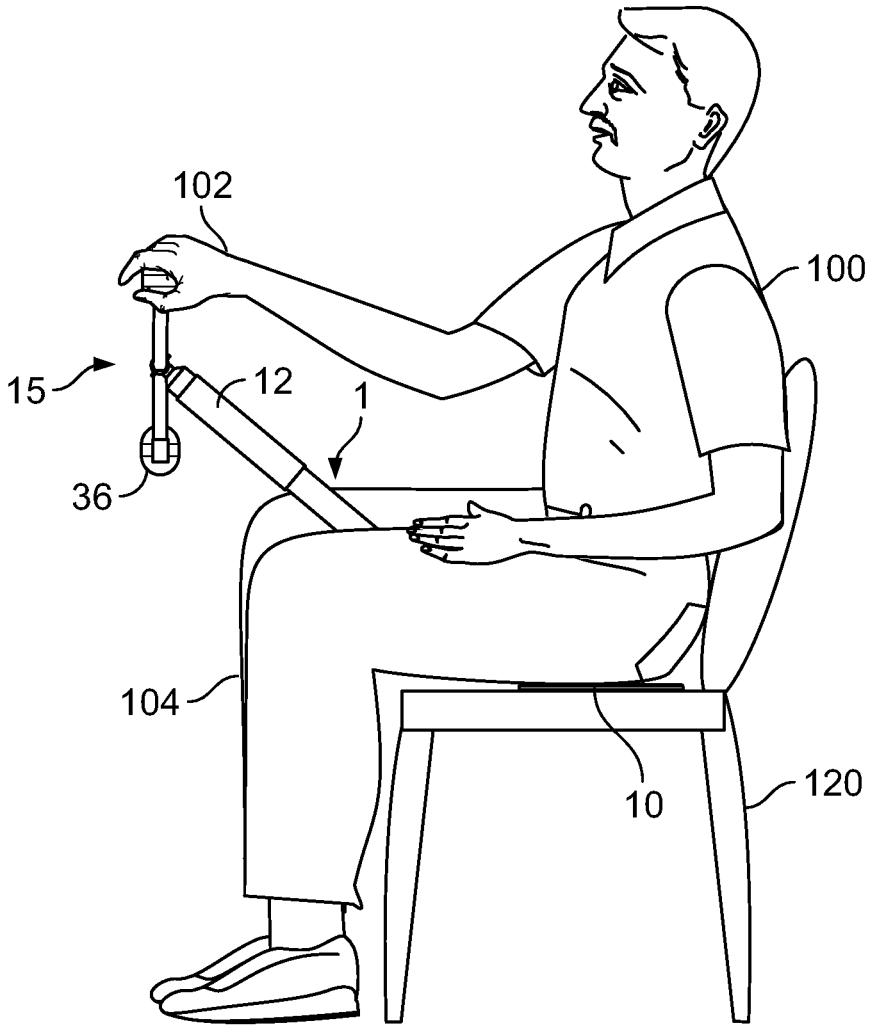
FIG. 8 illustrates a side view is shown of a user operating the portable hand cycle.

Referring to FIG. 8, a side view is shown of a user operating the portable hand cycle.

The portable hand cycle 1 is held in place by user 100, who sits on the seat 10 to compress it against the chair 120. The riser 12 extends between the user's legs 104.

The user 100 extends his hands 102 to hold the grips 36 of the hand cycle mechanism 15.

Figure 9:
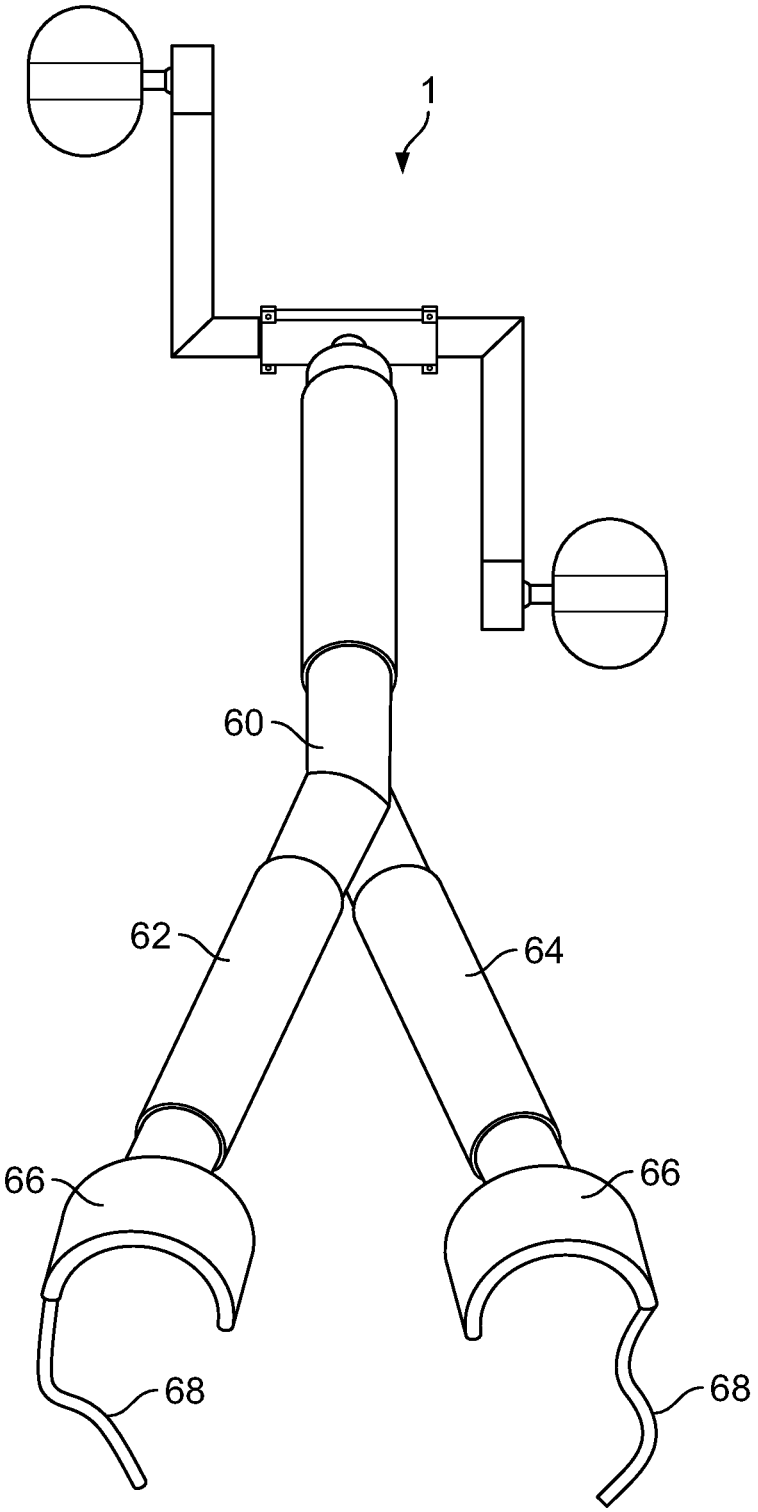
FIG. 9 illustrates a second embodiment of the portable hand cycle.

Referring to FIG. 9, a second embodiment of the portable hand cycle is shown.

In this embodiment, the portable hand cycle 1 uses a split riser 60 with a left riser leg 62 and a right riser leg 64.

Each riser leg 62/64 ends in a cuff 66 with optional band 68.

Figure 10:
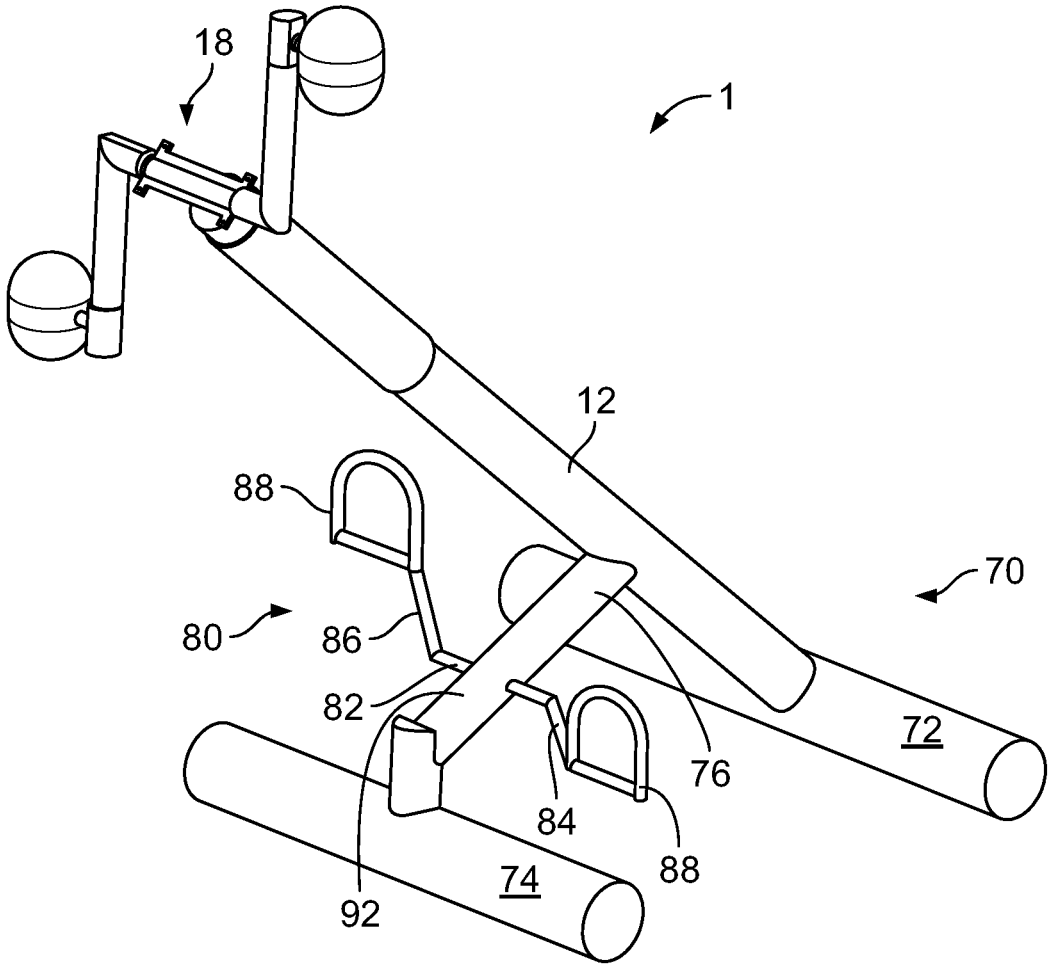
FIG. 10 illustrates a third embodiment of the portable hand cycle, further including a foot pedal mechanism.
Figure 11:
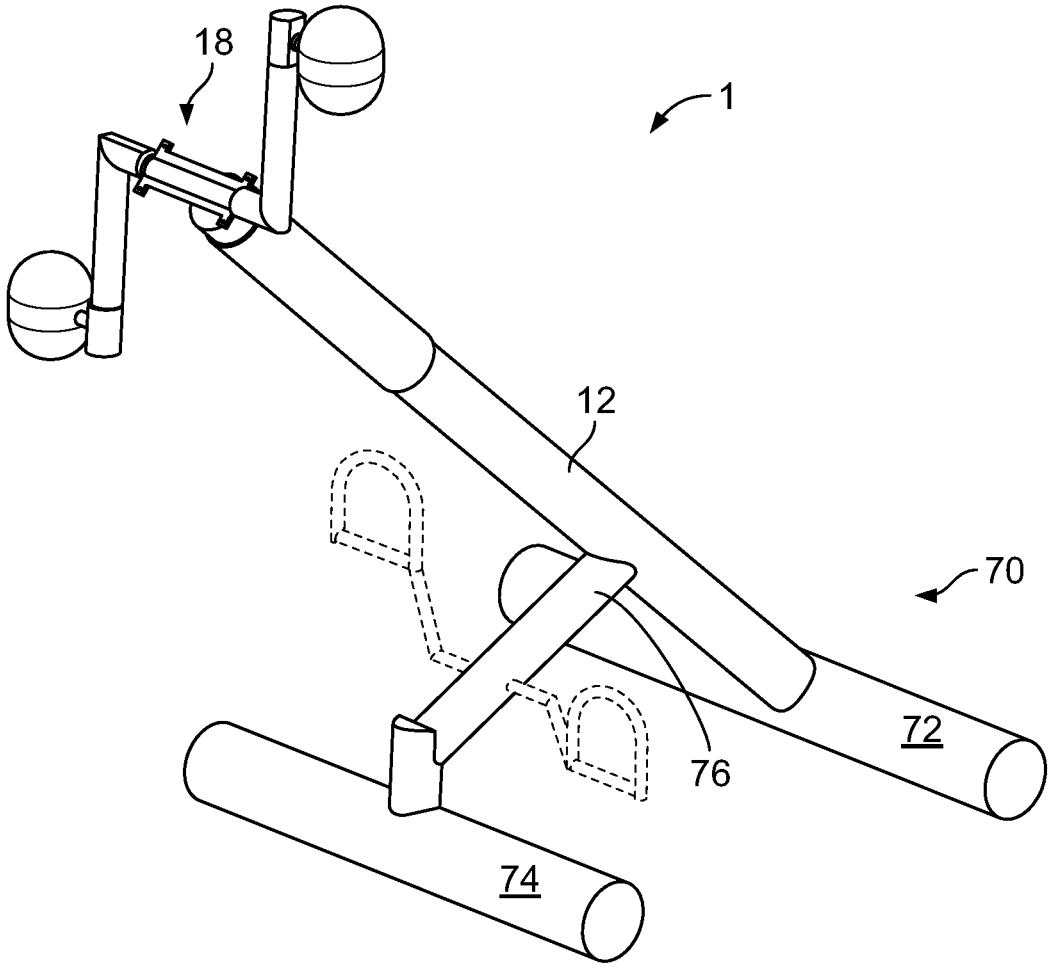
FIG. 11 illustrates a third embodiment of the portable hand cycle.

FIGS. 10 and 11 illustrate a third embodiment of the portable hand cycle, further including an optional foot pedal mechanism.

The lower end of the riser 12 includes a stand 70, formed from a rear foot 72 and front foot 74, the front foot 74 connected to the riser 12 by a support leg 76.

Optionally located along the support leg 76 is the foot pedal mechanism 80. The foot pedal mechanism 80 is formed from a foot axle 82, terminated at its ends with a left foot crank-arm 84 and a right foot crank-arm 86.

Each crank-arm 84/86 includes a pedal 88.

The foot axle 82 rotates within a bottom bracket 92, which is placed within the support leg 76.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A portable exercise device for use by a user in a seated position, the portable exercise device comprising:

a seat including an upper surface, a lower surface, and a front edge, wherein the seat is configured for compression between the user and a chair;

a riser non-pivotably coupled to and extending upwardly from the upper surface of the seat, the riser extending beyond the front edge of the seat at an obtuse angle measured from the upper surface to the riser; and a pair of rotating cranks affixed to the riser;

wherein the portable exercise device is configured such that while sitting in the seated position on the seat, the user rotates the pair of rotating cranks to exercise an upper body of the user.

2. The portable exercise device of claim 1, further comprising:

an axle within a sleeve, the sleeve connected to the riser;

the pair of rotating cranks mechanically connected to the axle;

the pair of rotating cranks being a left crank-arm and a right crank-arm, each of which terminates at a grip; and a stem between each crank-arm and its respective grip.

3. The portable exercise device of claim 2, wherein the grips are ovoid-shaped.

4. The portable exercise device of claim 2, further comprising:

a resistance mechanism;

whereby the resistance mechanism affects a rotational resistance of the pair of rotating cranks, thereby adjusting a difficulty of using the portable exercise device for the user.

5. The portable exercise device of claim 1, further comprising:

a resistance mechanism;

whereby the resistance mechanism affects a rotational resistance of the pair of rotating cranks, thereby adjusting a difficulty of using the portable exercise device for the user.

* * * * *